US010125527B2

(12) United States Patent
Smalls

(10) Patent No.: US 10,125,527 B2
(45) Date of Patent: Nov. 13, 2018

(54) CONTINUOUS HINGE FOR A PIVOTING DOOR

(71) Applicant: PEMKO MANUFACTURING COMPANY, INC., Ventura, CA (US)

(72) Inventor: Damond Maurice Smalls, Collierville, TN (US)

(73) Assignee: PEMKO MANUFACTURING COMPANY, INC., Ventura, CA (US)

( * ) Notice: Subject to any disclaimer, the term of this patent is extended or adjusted under 35 U.S.C. 154(b) by 0 days.

(21) Appl. No.: 15/007,339

(22) Filed: Jan. 27, 2016

(65) Prior Publication Data

US 2016/0215544 A1 Jul. 28, 2016

Related U.S. Application Data

(60) Provisional application No. 62/108,284, filed on Jan. 27, 2015.

(51) Int. Cl.
*E05D 7/00* (2006.01)
*E05D 5/12* (2006.01)
(Continued)

(52) U.S. Cl.
CPC ..... *E05D 7/009* (2013.01); *E05D 5/0223* (2013.01); *E05D 5/12* (2013.01); *E05D 5/14* (2013.01); *E05D 11/00* (2013.01); *E05D 11/06* (2013.01)

(58) Field of Classification Search
CPC ..... E05D 5/0223; E05D 7/009; E05D 5/12; E05D 5/14; E05D 11/00
(Continued)

(56) References Cited

U.S. PATENT DOCUMENTS 2,307,560 A * 1/1943 Apel ..... B61D 1/02 105/323
2,557,716 A 6/1951 Allee
(Continued)

FOREIGN PATENT DOCUMENTS

CN 104594745 A 5/2015
EP 0387663 A1 8/1990
(Continued)

OTHER PUBLICATIONS

Ives, Architectural Hinges, Continuous Hinges and Pivots, pp. A1-A50.

(Continued)

*Primary Examiner* — Emily M Morgan
(74) *Attorney, Agent, or Firm* — Dennis J. Williamson; Moore & Van Allen PLLC

(57) ABSTRACT

A continuous hinge comprises a first leaf and a second leaf each defining a longitudinal channel, a plurality of barrels defining bores open at each end, each of the barrels including a flange configured to be received in the channels of the first leaf or the second leaf, fasteners attaching the flanges of the barrels in the channels of the first and second leafs, wherein the barrels may be placed end-to-end for axially aligning the bores of the barrels, and a pivot pin extending through the bores of the barrels. The pivot pin is coextensive with the barrels for joining the barrels and the first and second leaves for relative pivoting movement about the pivot pin. The barrels attached to the first leaf are interspersed between the barrels attached to the second leaf in alternating relationship.

19 Claims, 11 Drawing Sheets

(51) Int. Cl.

| | |
|---|---|
| ***E05D 11/06*** | (2006.01) |
| ***E05D 11/00*** | (2006.01) |
| ***E05D 5/14*** | (2006.01) |
| ***E05D 5/02*** | (2006.01) |

(58) Field of Classification Search
USPC ..... 16/370, 271, 273, 309, 382, 387, 390, 16/392
See application file for complete search history.

(56) References Cited

U.S. PATENT DOCUMENTS

| | | | | | |
|---|---|---|---|---|---|
| 3,646,636 | A | | 3/1972 | Hives | |
| 4,679,277 | A | | 7/1987 | Shibata | |
| 4,922,987 | A | * | 5/1990 | Marontate | E05D 15/26 160/183 |
| 5,150,501 | A | * | 9/1992 | Pasternak | E05D 15/26 16/272 |
| 5,265,309 | A | * | 11/1993 | Oille | A47K 3/36 16/262 |
| 5,490,306 | A | | 2/1996 | Floyd et al. | |
| 5,971,187 | A | * | 10/1999 | Clee | B65D 11/18 16/252 |
| 6,253,525 | B1 | * | 7/2001 | Weber | B60P 1/4492 16/254 |
| 6,735,823 | B2 | | 5/2004 | Pelletier | |
| 6,859,980 | B2 | | 3/2005 | Baer | |
| 6,928,713 | B2 | | 8/2005 | Baer | |
| 8,191,205 | B2 | * | 6/2012 | Forrest | E05D 5/14 16/273 |
| 8,499,418 | B2 | | 8/2013 | Deveze | |
| 2008/0289147 | A1 | * | 11/2008 | Falato | E05D 3/12 16/382 |
| 2015/0330127 | A1 | * | 11/2015 | Lee | E05D 3/122 16/250 |

FOREIGN PATENT DOCUMENTS

| | | | | |
|---|---|---|---|---|
| ES | 2065849 | A2 | 2/1995 | |
| FR | 2638778 | A1 * | 5/1990 | E05D 3/02 |
| GB | 2160257 | A | 12/1985 | |
| GB | 2456144 | A | 7/2009 | |
| GB | 2451276 | B | 4/2012 | |
| WO | 2010037174 | A1 | 4/2010 | |
| WO | 2013064822 | A1 | 5/2013 | |

OTHER PUBLICATIONS

Markar, 400, 900 Series Continuous Toilet Partition Hinges, Jun. 4, 2009, http://www.markar.com/en/site/Markar-Architectural-Products-/Products/Hinges-by-Series . . . .

Pemko, Double Swing Hinge with Emergency Release Stop.

Fouquet, C., The Work Bench—Tubular Hinges, 1996, http://www.pilotsguide.com/rc/hinges.shtml.

Pemko Manufacturing Company, Inc., UK Patent Application No. GB1601516.6, Search Report under Section 17(5), dated Jun. 21, 2016.

Pemko Manufacturing Company, Inc., Canadian Patent Application No. 2,919,343, Office Action, dated Dec. 15, 2017.

* cited by examiner

CONTINUOUS HINGE FOR A PIVOTING DOOR

CROSS-REFERENCES

This application is related to U.S. provisional application No. 62/108,284, filed Jan. 27, 2015, entitled "CONTINUOUS HINGE", naming Damond Maurice Smalls as the inventor. The contents of the provisional application are incorporated herein by reference in their entirety, and the benefit of the filing date of the provisional application is hereby claimed for all purposes that are legally served by such claim for the benefit of the filing date.

BACKGROUND

A continuous hinge for a pivoting door is shown and described and, more particularly, a continuous hinge configured such that no portion of the hinge can be used as a ligature point and for minimizing the danger of pinching.

A door is typically attached to a frame using a plurality of discrete hinges such that the door pivots relative to the frame via the hinges. Door hinges are well-known in the hardware industry and are generally constructed of a pair of leaves respectively applied to an edge of the door and a rabbet of the door frame or a door jamb. Each leaf has one or more longitudinally-spaced knuckles configured as barrel-shaped sleeves extending from an edge. The spacing and size of the knuckles are such that the knuckles of the leaves interlock to form a cylindrical sleeve for receiving a hinge pin around which the leaves rotate. Bearings are sometimes positioned between the knuckles. Typical hinges allow the door to rotate in one direction relative to the door frame or door jamb.

Continuous hinges are generally applied to the entire length of a door. A continuous hinge also has leaves that are secured to the door and to the door frame. The leaves of the continuous hinge have a series of interlocking knuckles connected by a hinge pin extending the length of the door. Continuous hinges utilizing intermeshing gear teeth are also used in certain applications, particularly for relatively durable and high strength hinged connections or where some sealing action is desired.

When a door hinge is mounted to a door so that the door can open in one direction, the aligned knuckles are often physically accessible from the side of the door toward which the door is opened. This allows a person to remove the hinge pin from the hinge assembly or to use the protruding knuckles as a ligature point. Further, when the door is in an open position, gaps are formed between the hinged edge of the door and the door frame on both sides of the door. Fingers, limbs and other objects can fit into the gaps and be crushed by the edge of the door coming into close contact with the door frame.

For the foregoing reasons, there is a need for a new hinge for a pivoting door. The hinge should prevent a person from being able to gain access to the knuckles or hinge pins of the door hinge. The hinge should also minimize the possibility of pinching of a person or an object between the adjacent edges of the hinged members and the door and door frame.

SUMMARY

A continuous hinge is provided for connecting between a first member and a second member, wherein at least one of the first member or the second member is movable relative to the other member. The hinge comprises an elongated first leaf having an inner edge defining a partially enclosed longitudinal channel portion extending continuously along the length of the first leaf, the first leaf adapted for attachment to one of the first or second movable member, and an elongated second leaf having an inner edge defining a partially enclosed longitudinal channel portion extending continuously along the length of the second leaf, the second leaf adapted for attachment to the other of the first or second movable member. A plurality of barrels define longitudinal bores open at each end, each of the barrels including a longitudinally extending flange projecting from a peripheral surface, the flange configured to be received in the channel portion of either the first leaf or the second leaf. Means for attaching the flanges of the barrels in the channel portions of the first and second leafs is provided, wherein the barrels in the first and second leafs may be placed in closely spaced end-to-end relation for axially aligning the bores of the barrels. A pivot pin extends through the bores of the barrels, the pivot pin configured to be coextensive with the barrels for joining together the barrels and the first and second leaves for relative pivoting movement about the pivot pin. The barrels attached to the first leaf are interspersed between the barrels attached to the second leaf in alternating relationship.

In an aspect, each of the first and second leafs comprises a pair of elongated planar walls terminating in free inner edges in spaced relation for at least partially defining the channel portion of each leaf. A longitudinal web extends coextensively with and interconnects the walls of the leafs intermediate the transverse dimension of the walls. The web extends in a plane parallel with longitudinal axis of the first and second leaves and normal to a central transverse plane of the first and second leaves for at least partially defining the channel portions of each of the first and second leafs. The pair of walls of the first and second leafs terminates in outer edges in spaced relation, and further comprises a flange extending transversely in opposite directions from the outer edges of the pair of walls, the flanges being adapted to be secured to one or the other of the first and second movable members. The adjacent walls of the first and second leafs abut for maintaining the leafs in predetermined spaced apart relation when the leafs are rotated about the pin, a maximum spaced relation limiting the opening of the hinge to a maximum included angle between the leaves of less than about 105 degrees.

In another aspect, the longitudinally extending flange of each of the barrels comprises a pair of planar walls extending coextensively with the barrel in parallel spaced relation for defining a channel. The attaching means comprises at least one threaded fastener inserted through the web of the first or the second leaf for threaded engagement between the walls of the flange of the barrel for securing the barrel in the channel portion of the leaf In a further aspect, a plurality of bearings are configured to be disposed in the bore at each end of the barrels such that bores in the bearings are axially aligned with the bores of the barrels for slidingly receiving the pivot pin. The bearings longitudinally fill each of the spaces between the ends of the barrels and are configured to engage one another to facilitate relative rotation of the adjacent barrels.

In yet another aspect, an insert is configured to be disposed in the bore at each end of the barrels such that a bore of the insert is axially aligned with the bore of the barrel. The insert defines at least one longitudinal slot. The bearing further comprises a radial projection, and the slot is configured for slidingly receiving the projection for preventing relative rotation of the barrel and bearing. Each bearing may comprise a tongue at an outer end, the tongue extending normal to the longitudinal axis of the bearing for covering the end of the channel portion of each leaf when the bearing is disposed in the end of the barrel.

BRIEF DESCRIPTION OF THE DRAWINGS

For a more complete understanding of the continuous hinge, reference should now be had to the embodiments shown in the accompanying drawings and described below. In the drawings.

DESCRIPTION

Certain terminology is used herein for convenience only and is not to be taken as a limitation on the continuous hinge shown and described. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

As used herein, the term "open position" for a door means a door position other than a closed position, including any position between the closed position and a fully open position as limited only by structure around the door frame, which can be up to 180° from the closed position.

Figure 1:
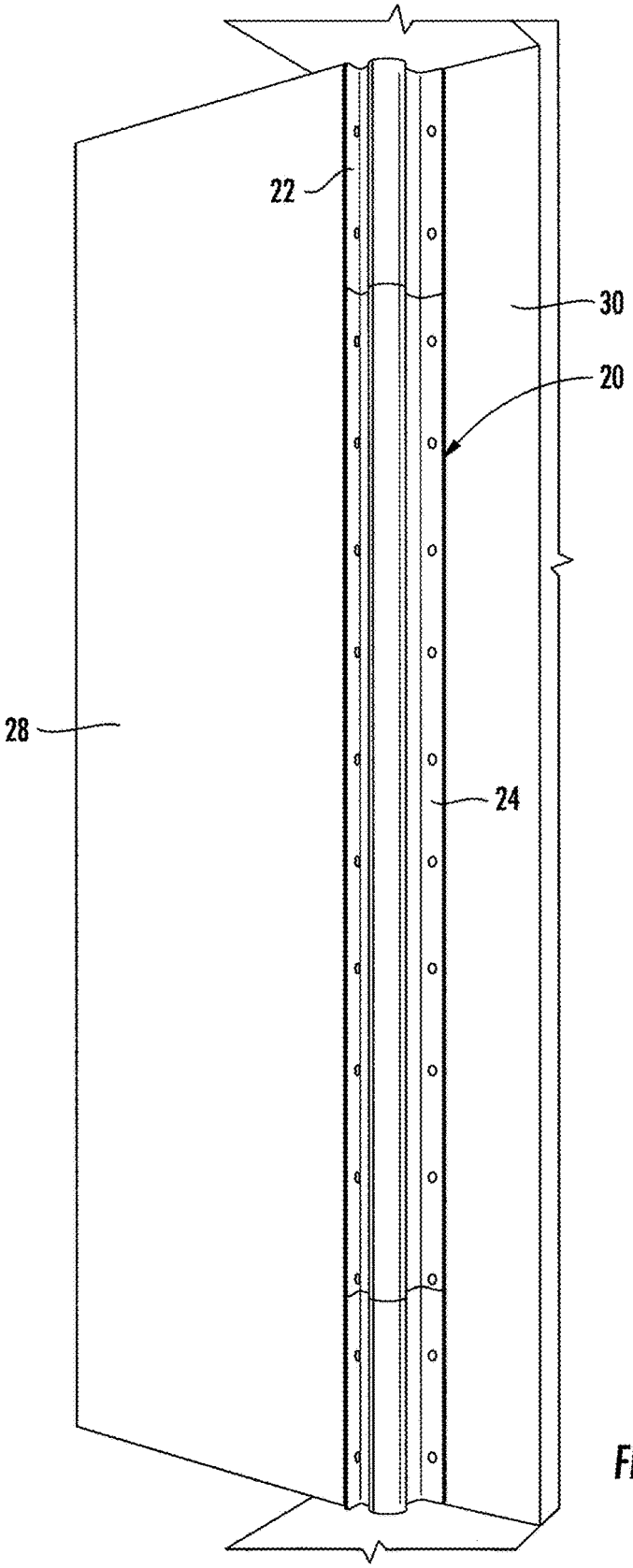
FIG. 1 is cut-away perspective view of an embodiment of a continuous hinge in position on a door.

Referring now to the drawings, wherein like reference numerals designate corresponding or similar elements throughout the several views, an embodiment of a continuous hinge assembly is shown in FIG. 1 and generally designated at 20. The continuous hinge 20 is secured between a door 28 and a door frame 30 for pivoting movement of the door 28 relative to the frame 30 between a closed position and an open position for opening and closing an opening through a building wall to allow a user to travel from one side of the wall to the other side of the wall. The door 28 and door frame 30 can be composed of wood, metal, plastic or other suitable material.

For the purpose of this description, only a portion of the door 28 and the door frame 30 are shown.

Figure 2:
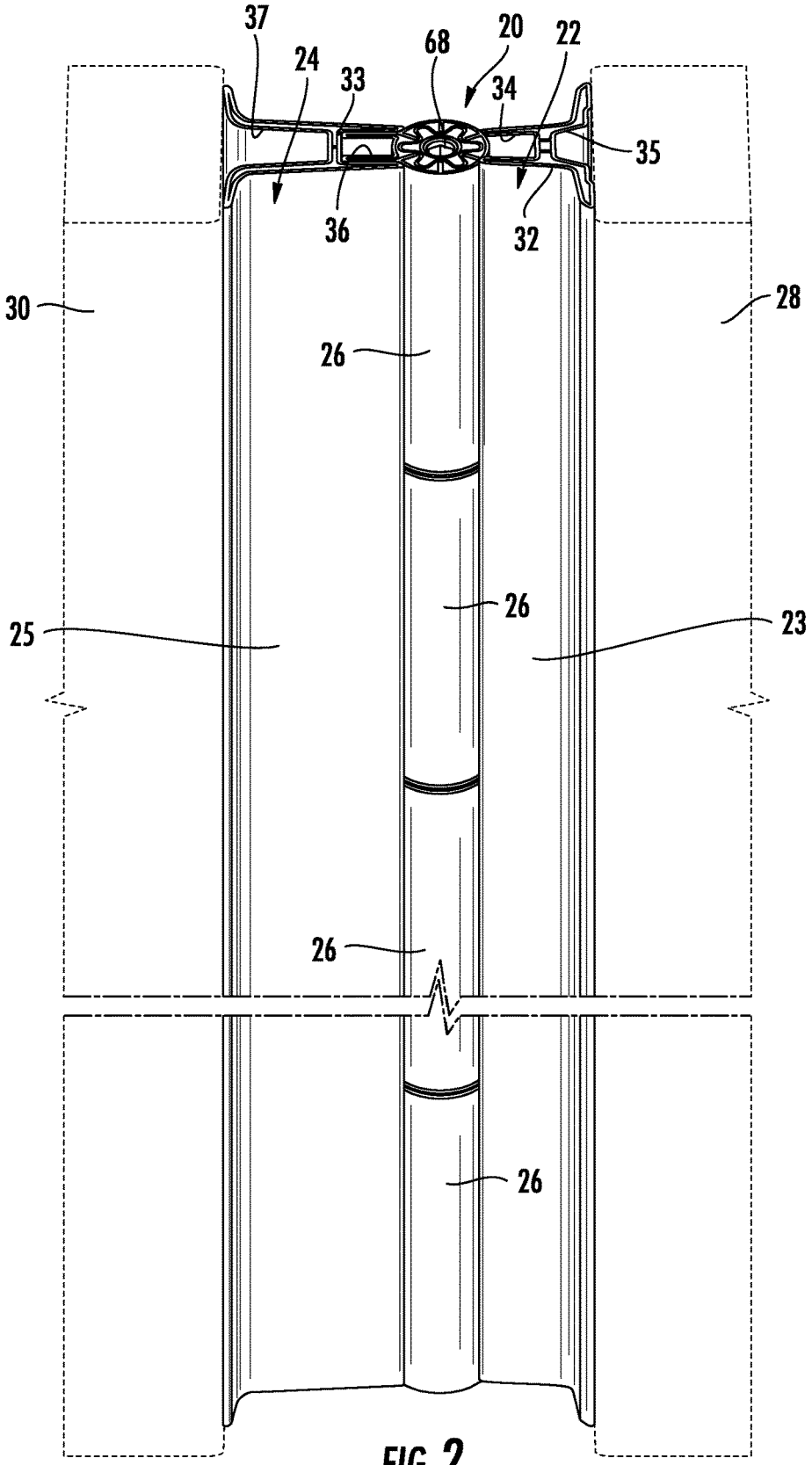
FIG. 2 is perspective view of a portion of an embodiment of a hinge assembly with a portion of door and adjacent door frame in dashed lines with the door in a closed position.
Figure 3:
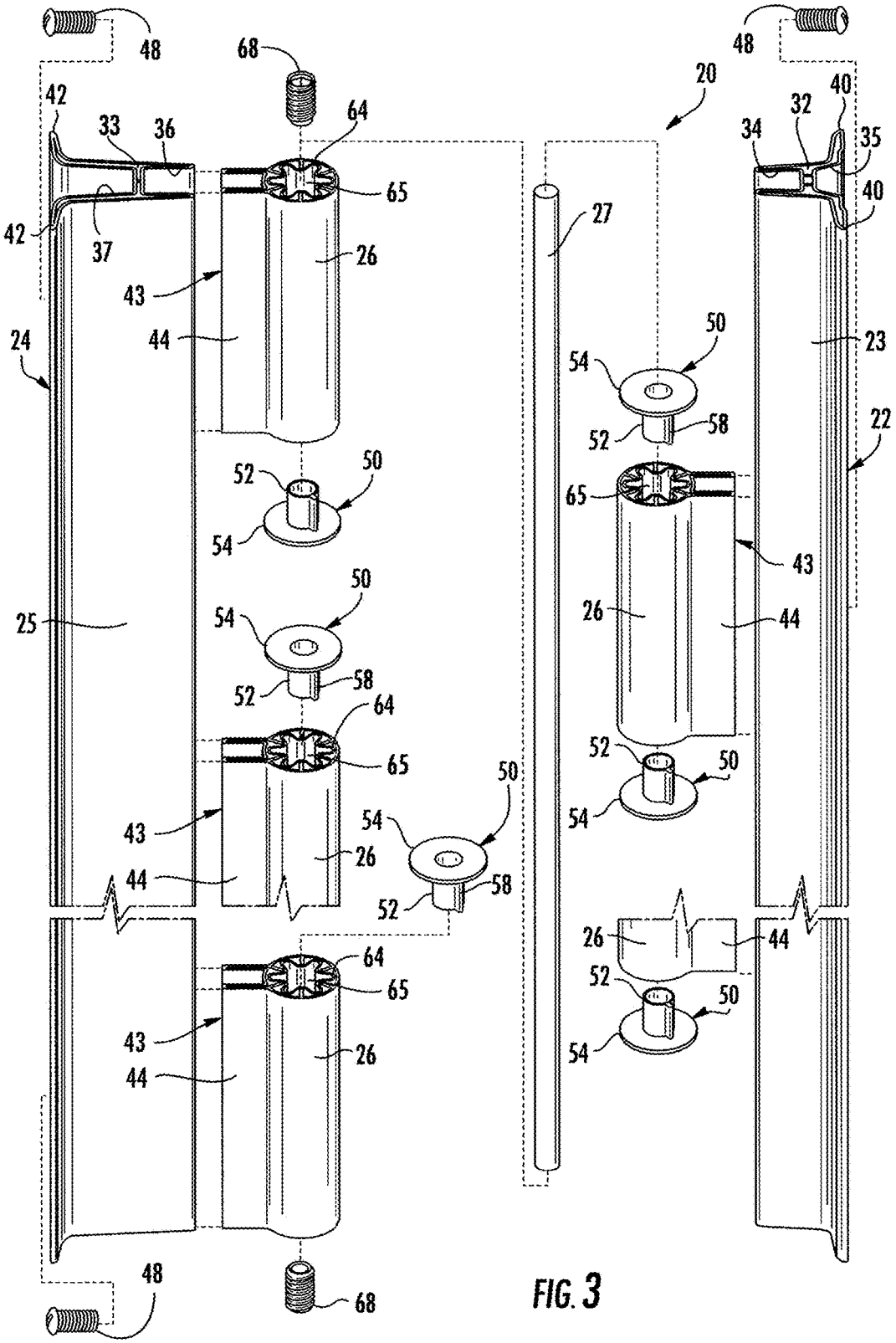
FIG. 3 is an exploded perspective view of the hinge assembly as shown in FIG. 2.
Figure 4:
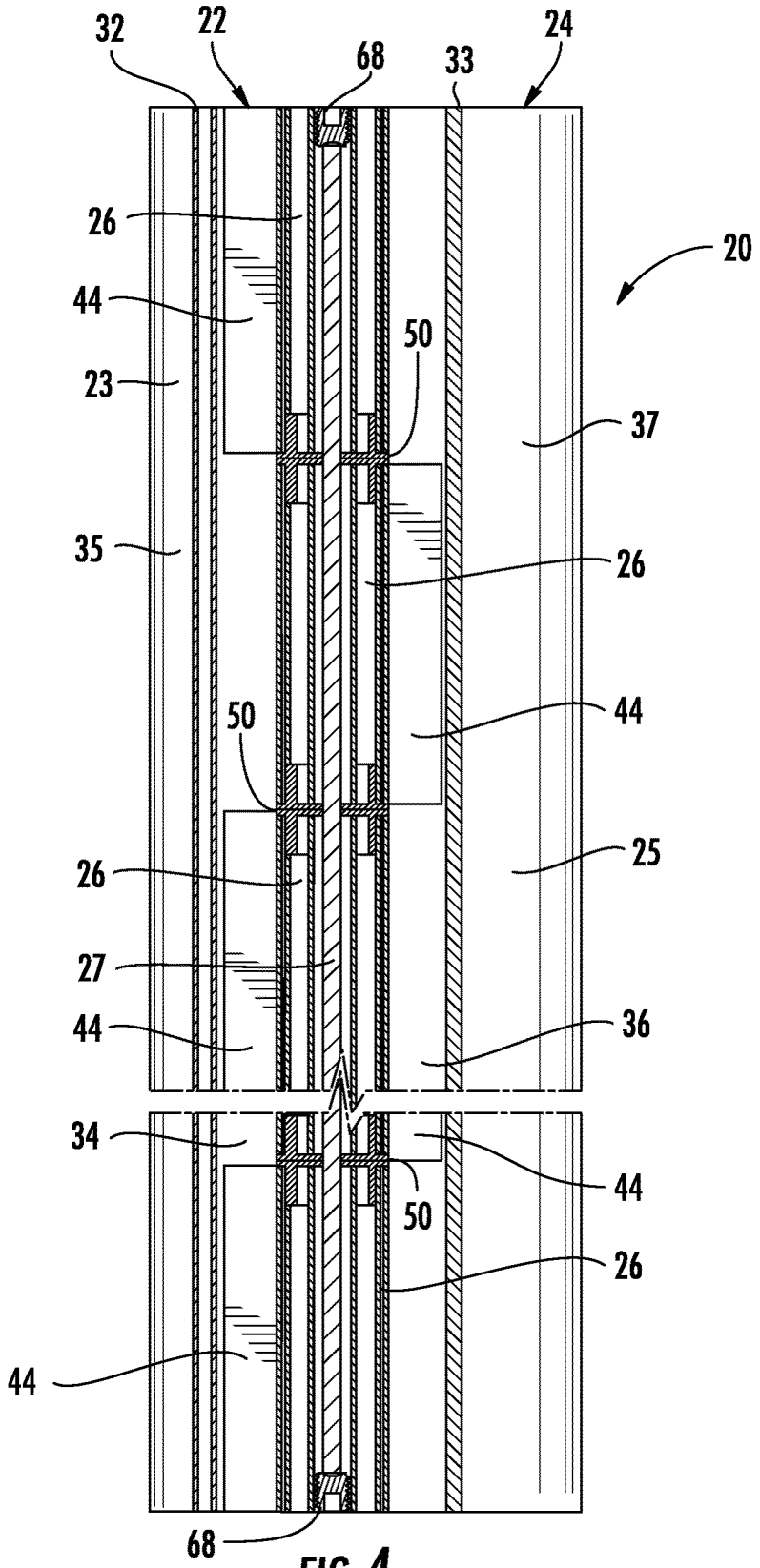
FIG. 4 is a longitudinal cross-section of the hinge assembly as shown in FIG. 2.

Referring to FIGS. 2-4, the hinge assembly 20 comprises a pair of elongated leaves 22 and 24, each leaf 22, 24 having along an inner edge at least one knuckle, or barrel 26, in which a pin 27 may be received for pivotally mounting the leaves 22, 24 together for relative rotation. A first leaf 22 is secured to an edge of a door 28 by any suitable fastening means, such as screws, and is hereinafter referred to as the door leaf. A second leaf 24 is secured by similar fastening means to an adjacent door frame or jamb 30, and is hereinafter referred to as the frame leaf. Each of the leaves 22, 24 extends the full height of the door 28 and the door jamb 30, respectively (FIG. 1).

Figure 5:
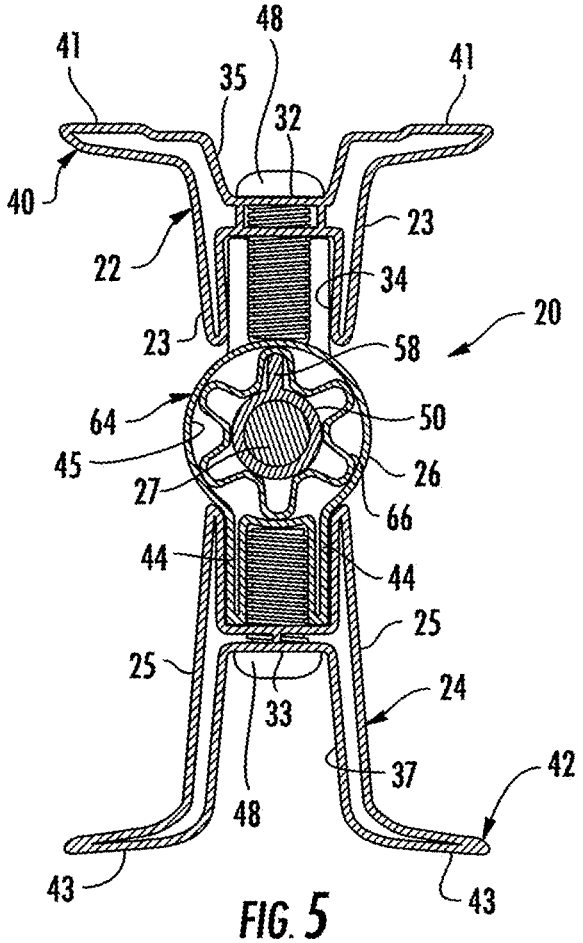
FIG. 5 is a transverse cross-section of the hinge assembly taken along line 5-5 of FIG. 2.

As best seen in FIG. 5, the leaves 22, 24 of the hinge assembly 20 are generally H-shaped in transverse cross-section, each leaf 22, 24 comprising opposed walls 23, 25 which taper outwardly from an inner portion to an outer portion. The walls 23, 25 are interconnected by respective planar transverse webs 32, 33 intermediate the length of the walls 23, 25. The webs 32, 33 extend longitudinally the length of the leaves 22, 24 thereby forming with the walls 23, 25 a pair of U-shaped longitudinal channels 34, 35, 36, 37 on the inner and outer sides of the webs 32, 33. The outer edge of the walls 23, 25 include mounting portions comprising base flanges 40, 42 extending transversely outwardly from the walls 23, 25. The base flanges 40, 42 have substantially planar mounting surfaces 41, 43 configured to sit flush against the edge surface of the door 28 and the surface of the jamb 30, respectively, for fastening. The leaves 22, 24 may be secured to the door 28 and the door jamb 30 using a plurality of longitudinally spaced fasteners passing through the base flanges 40, 42 and into the door 28 and the door jamb 30 (FIG. 1).

The continuous hinge assembly 20 may be formed from aluminum in order to provide high strength together with lightweight and a high degree of resistance to corrosion. A variety of other rigid durable materials are also suitable for the hinge assembly 20 including, but not limited to, brass, steel, stainless steel, titanium, or alloyed metals; synthetic resins and plastics including polyimides, polytetrafluoroethylenes, polyacetals (both homopolymers and copolymers with silicones) and polypropylene; composites; or any other suitable material as is known and used in the art. The hinge assembly 20 may be manufactured by conventional techniques such as, but not limited to, roll forming, extruding, casting, molding, and the like. For example, the leaves 22, 24 may be conveniently formed by extrusion since the profile of the leaves 22, 24 is uniform over the length thereof. Other techniques, such as milling, machining, boring, drilling, tapping, punching and the like may also be used to prepare the hinge assembly 20. The selection of materials and manufacturing techniques are well within the purview of those of ordinary skill in the art and will not be expounded upon herein.

Figure 6:
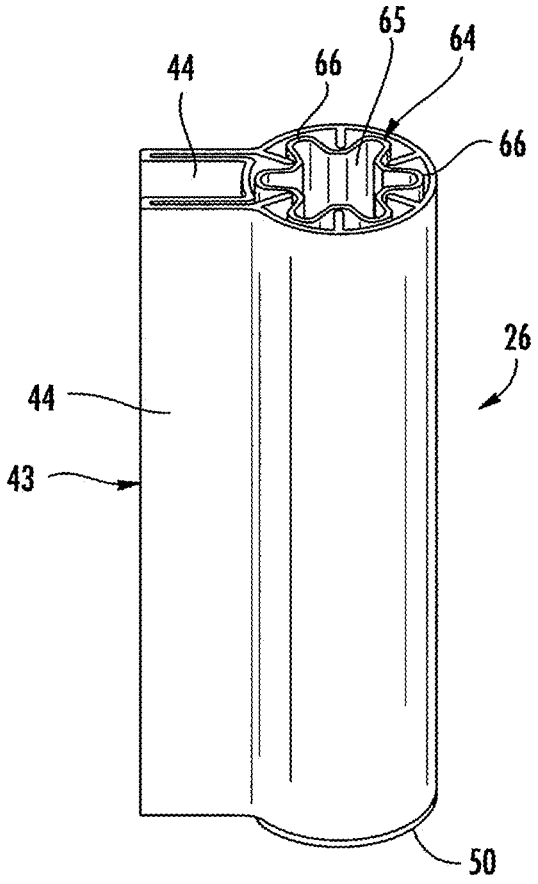
FIG. 6 is a perspective view of an embodiment of a knuckle for use with the hinge assembly as shown in FIG. 2.

Referring now to FIG. 6, each barrel 26 is generally cylindrical and defines a substantially circular passageway, or bore 45, which extends longitudinally through the barrel 26. The barrels 26 have an integral flange 43 comprising a pair of spaced parallel planar arms 44 extending longitudinally along the outer surface of the barrel 26. The arms 44 extend the full length of the barrel 26. The diameter of each barrel is configured to be larger than the width of the inner channels 34, 36 of the leaves 22, 24. The distance between the outer surfaces of the pair of arms 44 corresponds to the width of the inner channels 34, 36 of the leaves 22, 24. As shown in FIG. 5, the inner channels 34, 36 of the leaves 22, 24 are configured for slidably receiving the arms 44 of the barrels 26 in closely spaced relationship. The barrels 26 may be slid longitudinally in the channels 34, 36 along the length of the leaves 22, 24 to a selected position with respect to the leaf In one embodiment, the barrels 26 are fixed in position in the channels 34, 36 using threaded fasteners 48 extending through the webs 32, 33 and into the space defined by the arms 44 of the barrel 26. The fasteners 48 are accessible and operable via the outer channels 35, 37 of the leaves 22, 24 using a driver, such as screwdriver. The webs 32, 33 may have an array of longitudinally spaced apertures through which the fasteners 48 may be advanced for securing the position of the barrels 26 on the leaves 22, 24.

Figure 7:
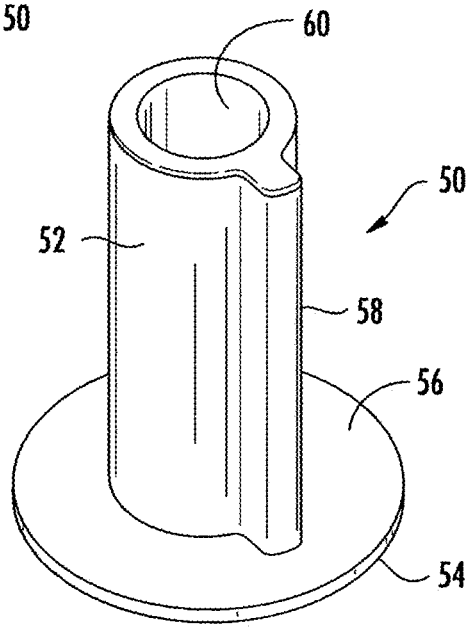
FIG. 7 is a perspective view of an embodiment of a bearing for use with the hinge assembly as shown in FIG. 2.

An embodiment of a bearing for use with the hinge assembly 20 is shown in FIG. 7 and generally designated at 50. The bearing 50 comprises an elongated cylindrical portion 52 having a circular planar cap 54 at one end. The cap 54 has a larger diameter than the cylindrical portion 52 and projects laterally from the outer surface of the cylindrical portion. The outside diameter of the cap 54 is substantially the same as the outside diameter of the barrels 26. The intersection between the cylindrical portion 52 and the cap 54 forms an annular surface or shoulder 56. The bearing 50 may preferably be formed from any appropriate plastic material, such as nylon.

The bearing 50 comprises a radially projecting key 58 extending longitudinally along the outer surface of the cylindrical portion 52 of the bearing 50. In the embodiment shown, the key 58 extends the full length of the bearing 50. The bearing 50 defines a central longitudinal bore 60 for receiving the pin 27 when the bearing is inserted into the barrel 26.

A star-shaped insert 64 is configured to be disposed in the ends of the barrels 26 for receiving the bearings 50 (FIGS. 5 and 6). The insert 64 is retained by a press fit, but other means of securing the insert in the barrel 26 may be used including, for example, adhesives, welding, soldering, or any other means within the skill in the art. The insert 64 has six radially extending points 66, each of which defines a slot. It is understood that any number of points and slots may be provided. The inner surfaces of the points 66 are disposed circumferentially about an opening 65 in the insert 64 and configured to receive the cylindrical portion 52 of the bearing 50 between the points 66. The slots defined by the points 66 of the insert 64 are sized and configured to slidably receive the radially projecting key 58 on the bearing 50 when the bearing 50 is press fit into the opening 65 in the insert 64 in the barrel 26. This arrangement functions as a mechanical locking mechanism for causing the bearing 50 to rotate with the barrel. The inner annular surface 56 of the end cap 54 fits against the end of the barrel 26 to prevent the bearing 50 from sliding into the barrel. The bearings 50 are diposed between adjacent ends of the barrels 26 for longitudinal support of the barrels during relative rotation of the leaves 22, 24. The bearings 50 allow the barrels 26 to turn in unison without binding with one another or with the pin 27.

Figure 13A:
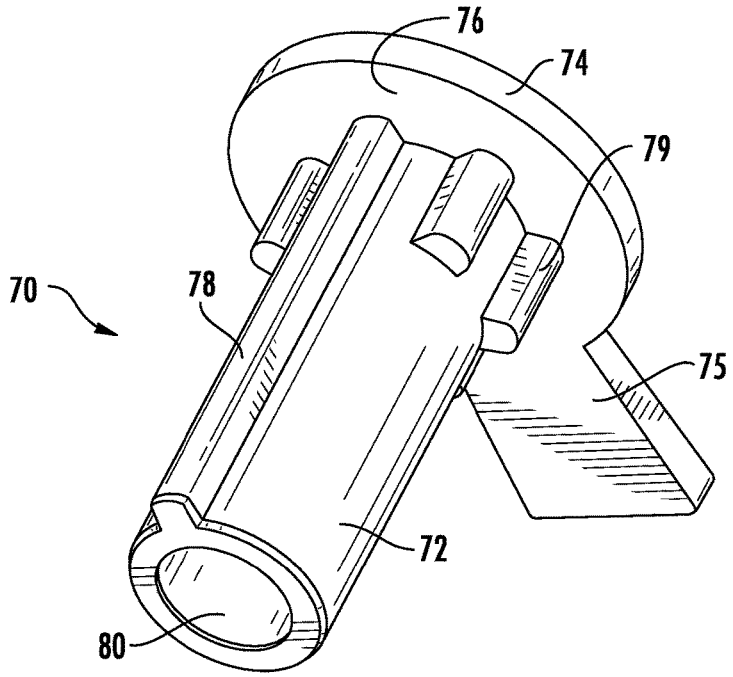
FIGS. 13A, 13B and 13C is a perspective view, a side elevation view and a bottom plan view, respectively, of another embodiment of a bearing for use with the hinge assembly as shown in FIG. 2.
Figure 13B:
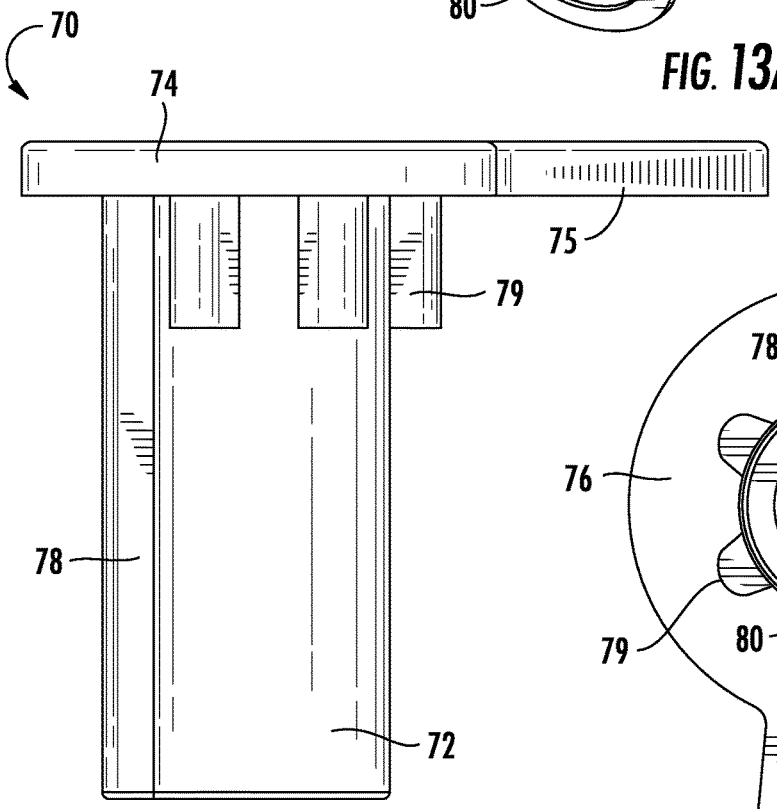
Figure 13C:
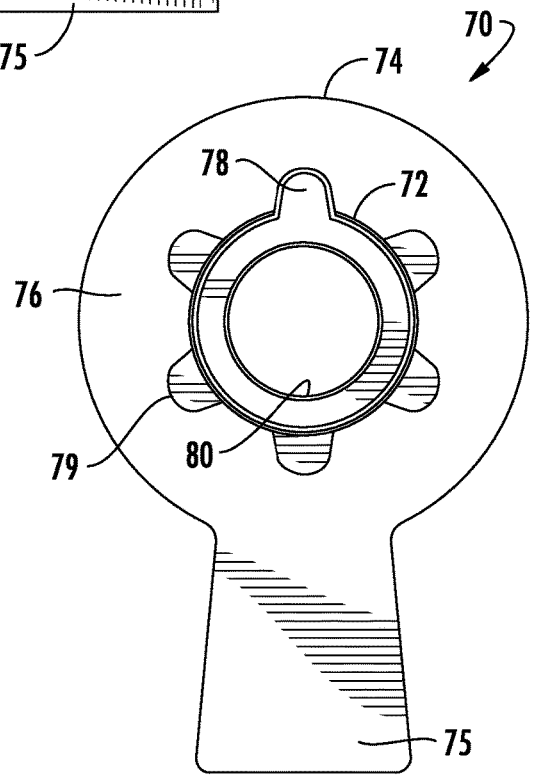

Another embodiment of a bearing for use with the hinge assembly 20 is shown in FIGS. 13A-13C and generally designated at 70. The bearing 70 comprises an elongated cylindrical portion 72 having a circular planar cap 74 at one end. The end cap 74 has a larger diameter than the cylindrical portion 72 and projects laterally from the outer surface of the cylindrical portion. The outside diameter of the cap 74 is substantially the same as the outside diameter of the barrel 26. A planar tongue 75 extends from the cap 74 in the same plane as the cap 74. The configuration of the tongue 75 corresponds to the transverse dimension of the pair of planar wall 23, 25 extending from each leaf 22, 24. The intersection between the cylindrical portion 72 and the cap 74 forms an annular surface or shoulder 76. The bearing 70 may preferably be formed from any appropriate plastic material, such as nylon.

The bearing 70 comprises a radially projecting key 78 extending longitudinally along the outer surface of the cylindrical portion 72 of the bearing 70. In the embodiment shown, the key 78 extends the full length of the bearing 70. The bearing 70 defines a central longitudinal bore 80 for receiving the pin 27 when the bearing is inserted into the barrel 26

The bearing 70 also has five radially spaced projections 79 extending longitudinally from the cap 74 along the outer surface of the cylindrical portion 72 of the bearing 70 parallel to the key 78. The key 78 and the projections 79 are sized and configured to slidably fit between the points 66 of the insert 64 when the bearing 70 is press fit into the insert 64 in the barrel 26. This arrangement functions as a mechanical locking mechanism for causing the bearing 70 to rotate with the barrel. The inner annular surface 76 and tongue 75 of the end cap 74 fit against the end of the barrel 26 and the arms 44 to prevent the bearing 70 from sliding into the barrel and for covering the gap between the arms 23, 25 of each leaf 22, 24. The bearings 70 are disposed between adjacent ends of the barrels 26 for longitudinal support of the barrels during relative rotation of the leaves 22, 24. The bearings 70 allow the barrels 26 to turn in unison without binding with one another or with the pin 27

In lieu of the insert 64, as described above, the barrels 26 may be provided with one or more longitudinal slots which are cooperatively configured and sized to receive the key 58, 78 on the bearing 50, 70. Other suitable alternatives may also be used to fix or secure the bearings 50, 70 to the barrels 26, for example, a set screw or pin, threaded fasteners, adhesives, welding, soldering, or other means within the skill in the art.

Figure 8:
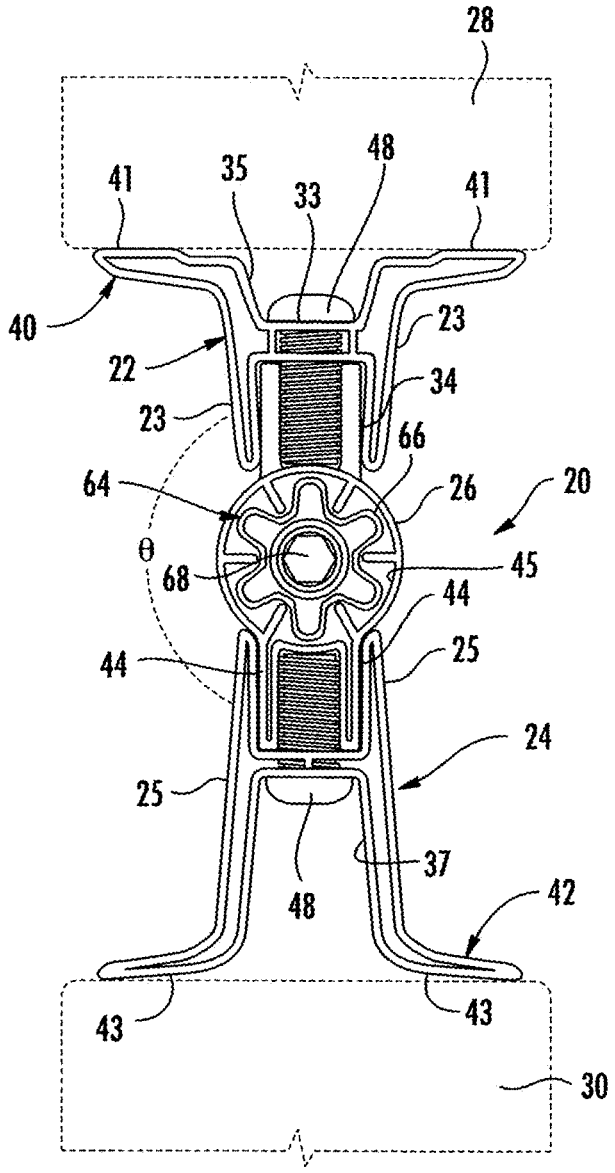
FIG. 8 is a top plan view of the hinge assembly including portions of the door and the frame as shown in FIG. 2.

The pin 27 is configured to be received in the substantially coaxially aligned bores 60, 80 of the bearings 50, 70 disposed in the openings 65 in the inserts 64 in the barrels 26. The aligned bores 60, 80 form a sleeve for receiving the circular pin 27. When disposed in the bearings 50, 70, the pin 27 pivotally connects the barrels 26 and associated leaves 22, 24 so that the leaves 22, 24 may be rotatably moved through an angular displacement (θ). The length of the pin 27 is adapted to be slightly less than the total length of the hinge assembly 20 such that the ends of the pin 27 do not extend beyond the ends of the end barrels 26. Accordingly, when the pin 27 is disposed in the barrels 26, the ends of the pin will be within the bores 60, 80 of the outermost bearings 50, 70. After the pin 27 is disposed in the hinge assembly 20, a set screw 68 is threaded into each of the ends of the hinge assembly 20 to fix the position of the pin 27 (FIG. 8).

In use, the barrels 26 are assembled and attached to the leaves 22, 24 in end-to-end contact in a longitudinal alternating sequence so that the total combined length of the barrels 26 is substantially the same as the length of the leaves 22, 24. As shown in FIGS. 2-4, the top and bottom barrels 26 are attached to the frame leaf 24. The barrels 26 of the hinge assembly 20 can be manufactured in standard sizes and combined to provide a hinge assembly 20 of the desired length. Alternatively, the length of one or more barrels may be adjusted to achieve a predetermined overall desired length. In this manner the length of the hinge assembly 20 is customizable to a particular application.

Figure 10:
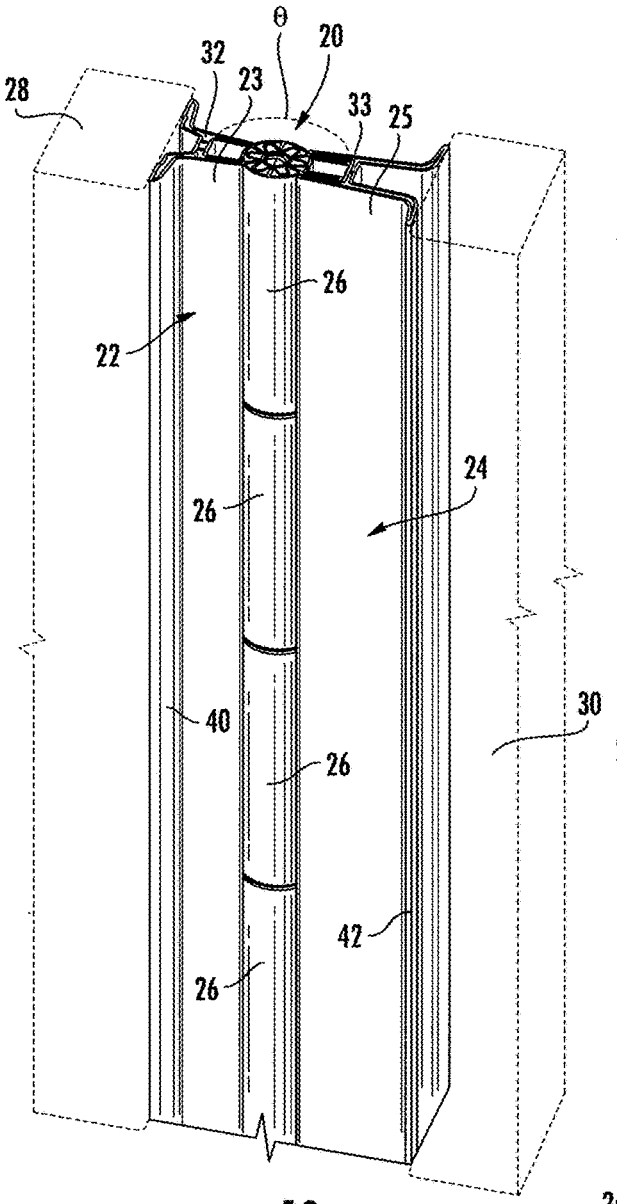
FIG. 10 is a perspective view of the hinge assembly and portions of the door and the frame as shown in FIG. 8.

The leaves 22, 24 of the hinge assembly 20 are then fastened to the hinged objects, such as an edge of the door and the door frame, using fasteners such as threaded screws or bolts, adhesive, welds, or any other suitable means known to those skilled in the art. The plurality of fasteners is longitudinally spaced along the base flanges 40, 42 and extending into the door 28 and the door frame 30. As shown in FIG. 1, the hinge assembly 20 extends the full length of the door 28, substantially filling the gap between the leaves 22, 24 and the door 28 and door frame 30. The barrels 26 are configured and sized so that there is little or no gap between the barrels 26 or between the barrels 26 and the inner edges of the walls 23 and the leaves 22, 24 (FIGS. 8 and 10).

Figure 9:
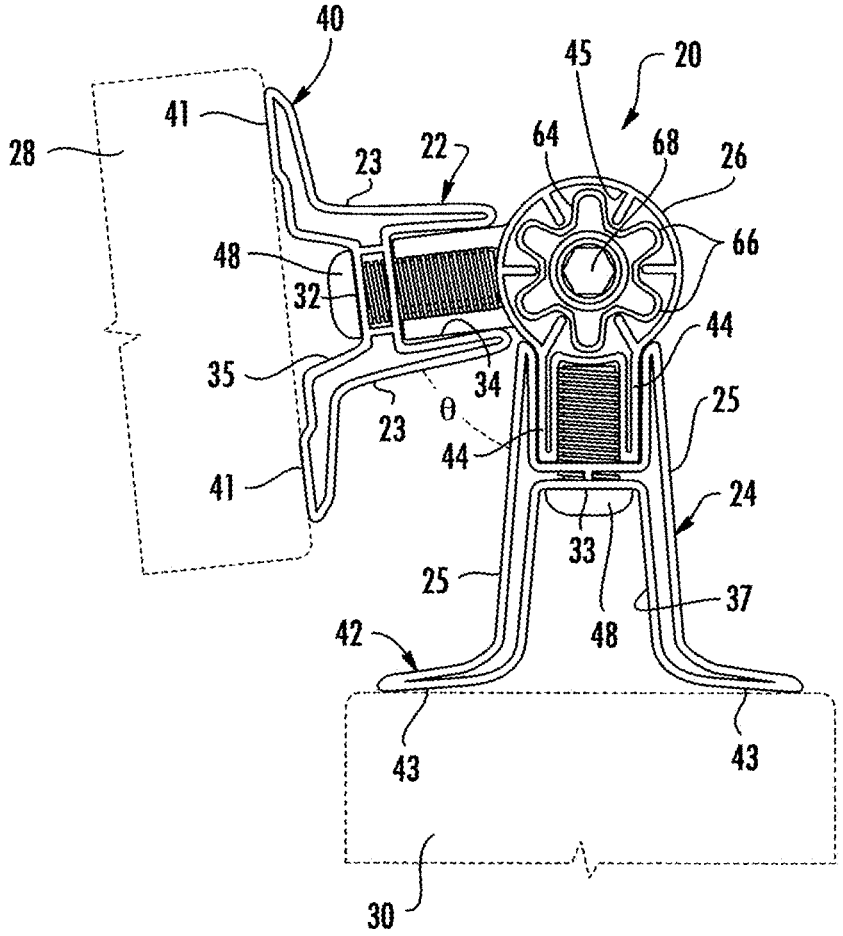
FIG. 9 is a top plan view of the hinge assembly and portions of the door and the frame as shown in FIG. 6 with the door in an open position.
Figure 11:
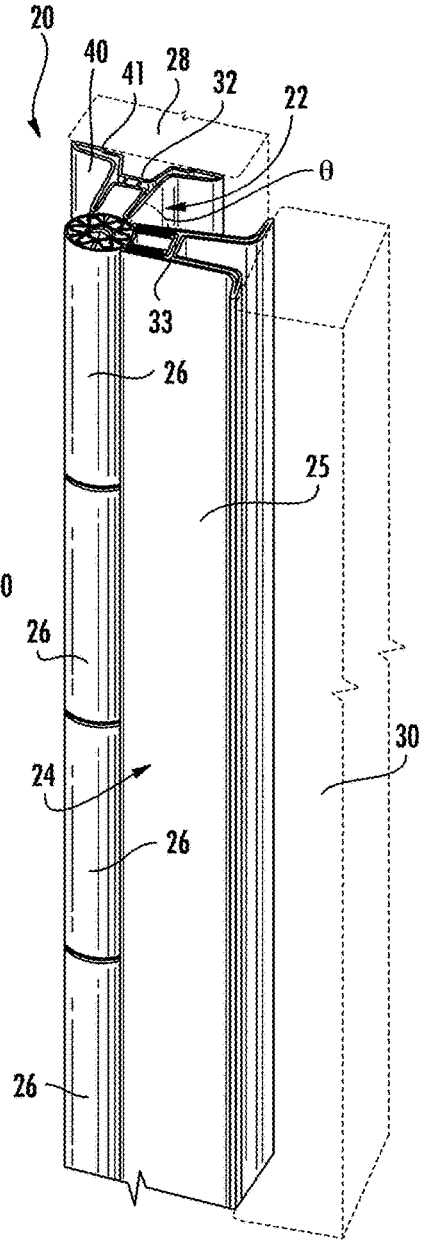
FIG. 11 is a perspective view of the hinge assembly and portions of the door and the frame with the door in an open position opposite to FIG. 9.
Figure 12:
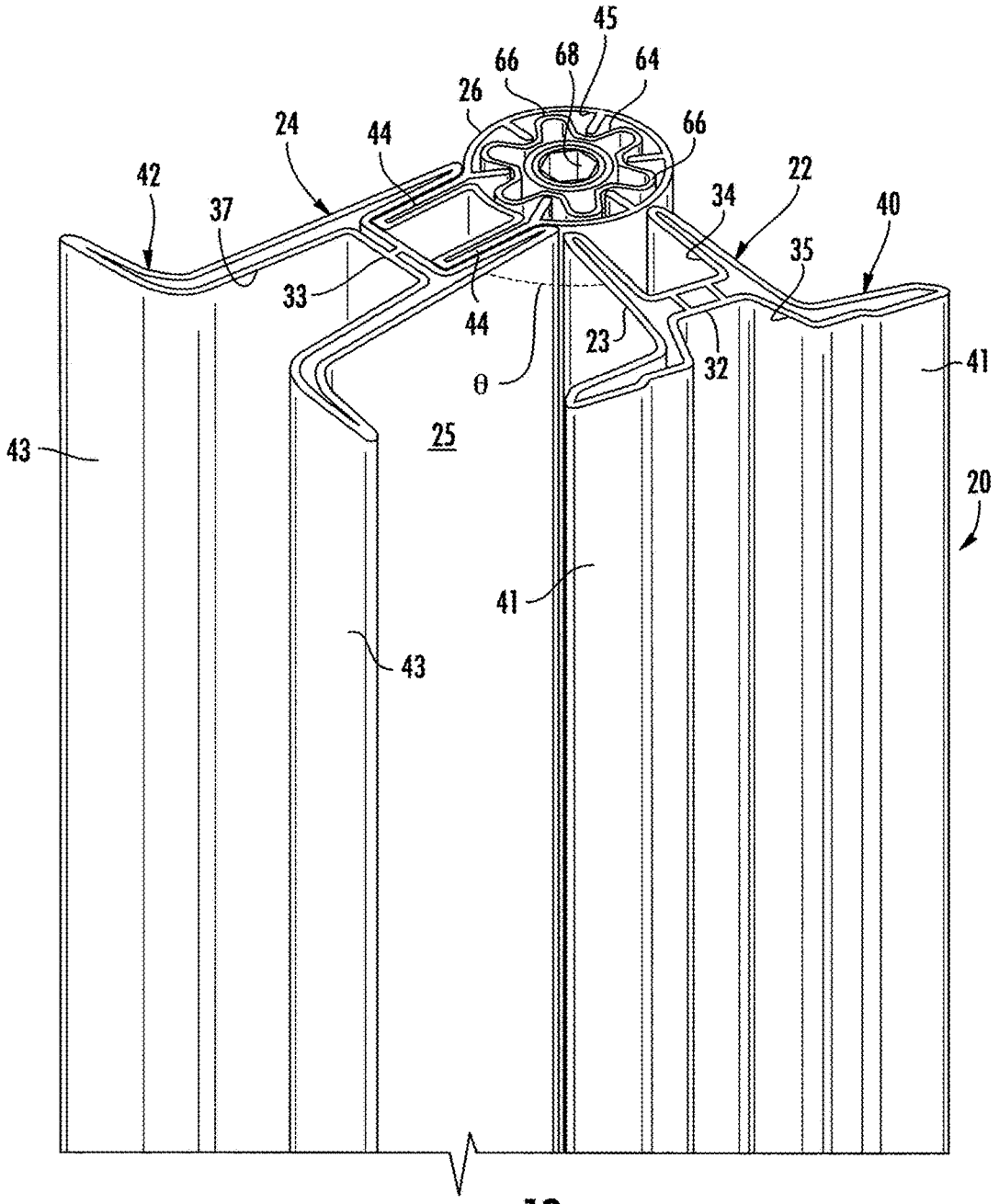
FIG. 12 is a close-up perspective view of the hinge assembly in a position corresponding to an open position of the door as shown in FIG. 11.

The hinge assembly 20 allows the door 28 to rotate relative to the door frame 30 in both directions. As the door is opened, the leaves 22, 24 of the hinge assembly 20 rotate progressively around the pin 27 to an open position of the door (FIGS. 9, 11 and 12). One surface of each of the leaves 22, 24 moves angularly towards the other during door 28 opening thereby functioning to lessen the angle θand "close" the gap between the leaves 22, 24. Referring to FIGS. 11 & 12, the leaves 22, 24 are configured so as to provide a stop to limit the angle to which the hinge assembly 20 and the door 28 may be opened. The stop comprises the inner free ends of the walls 23, 25 of the leaves 22, 24. The walls 23, 25 are in spaced arcuate relation such that the adjacent inner ends of the walls 23, 25 abut one another at a predetermined relative angular position which prevents any further opening of the door 28. In one embodiment, the angular displacement measured in degrees of angle θbetween the leaves 22, 24 is about 102 degrees when the door is fully open in either direction from the closed position. It is understood that the leaves 22, 24 may be opened to a position greater or less than 102 degrees depending on the design requirements and physical limitations of the intended application.

The continuous hinge assembly 20 has many advantages, including preventing access to the barrels or the pin for use as a ligature or other unintended use. Moreover, there is little or no gap or crevice existing between the edge of the door and the door frame or door jamb when the door is in an open position. The hinge is continuous along the edge of the door and the components are closely adjacent to each other so there is no gap between the abutting edges of the hinge or between the door and the door frame. This arrangement of the hinge minimizes the risk of crush injury of fingers or limbs caused by conventional hinges since fingers and limbs can no longer be placed within a gap on the hinge side of the door. The hinge can be equipped with a desired number of barrels and a combined length of barrels which are best suited for the service requirements of the application.

Although the present invention has been shown and described in considerable detail with respect to a few exemplary embodiments thereof, it should be understood by those skilled in the art that we do not intend to limit the continuous to the embodiments since various modifications, omissions and additions may be made to the disclosed embodiments without materially departing from the novel teachings and advantages, particularly in light of the foregoing description. For example, the continuous hinge assembly shown may be provided for attachment to any pair of hinged objects, including a window, gate, lid and the like. Accordingly, it is understood that the continuous hinge assembly is expressly not limited for use in only door installations, but may be used in any application where at least two hinged objects are to be pivotally connected. Accordingly, we intend to cover all such modifications, omission, additions and equivalents as may be included within the spirit and scope of the continuous hinge assembly as shown and described herein and as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A continuous hinge for connecting between a first member and a second member, wherein at least one of the first member and the second member is movable relative to the other one of the first member and the second member, the hinge comprising:

an elongated first leaf having a first mounting surface that abuts the first member and a first outer channel extending along the length of the first mounting surface such that the first mounting surface is disposed transverse to the first outer channel, the first outer channel being recessed relative to the first mounting surface;

the elongated first leaf having a first inner channel extending continuously along the length of the first leaf;

an elongated second leaf having a second inner channel extending continuously along the length of the second leaf;

a plurality of first barrels defining longitudinal bores, each of the first barrels including at least one longitudinally extending arm projecting from a peripheral surface, the at least one longitudinally extending arm received in the first inner channel of the first leaf and a plurality of second barrels defining longitudinal bores, each of the second barrels including at least one longitudinally extending arm projecting from a peripheral surface, the at least one longitudinally extending arm received in the second inner channel of the second leaf, the first and second barrels in an end-to-end relation with the bores of the first and second barrels being aligned, the first barrels alternating with the second barrels;

a plurality of first fasteners extending through the first leaf and engaging and being secured to the plurality of first barrels, the plurality of first fasteners being disposed at least partially in the first outer channel such that the plurality of first fasteners are accessible from the first outer channel and are recessed relative to the first mounting surface;

a pivot pin extending through the bores of the first and second barrels.

2. The hinge as recited in claim 1, wherein each of the first and second leafs comprises a pair of elongated planar walls having a longitudinal axis and terminating in free inner edges in spaced relation for at least partially defining the inner channel of each of the first and second leafs, and further comprising a longitudinal web extending coextensively with and interconnecting the walls of each of the first and second leafs intermediate the transverse dimension of the walls orthogonal to the longitudinal axis, the web extending in a plane parallel with longitudinal axis of the first and second leaves and normal to a central transverse plane of the first and second leafs for at least partially defining the inner channel of each of the first and second leafs.

3. The hinge as recited in claim 2, wherein the first leaf and the second leaf pivot about the pivot pin between a closed position and a fully open position where in the fully open position the inner edge of a wall of the first leaf abuts the inner edge of an adjacent wall of the second leaf when the first and second leafs are rotated about the pin to a maximum rotation position for maintaining the leafs in predetermined minimum spaced apart relation.

4. The hinge as recited in claim 2, wherein the at least one longitudinally extending arm of each of the barrels comprises a pair of arms extending coextensively with the barrel in parallel spaced relation for defining a channel.

5. The hinge as recited in claim 4, wherein the plurality of first fasteners extend through the web of the first leaf for threaded engagement between the pair of arms of the barrel for securing the barrel in the inner channel of the first leaf.

6. A hinge as recited in claim 1, further comprising a plurality of bearings, each bearing having a bore and disposed in the bores of the barrels at each end of the barrels such that the bores of the bearings are axially aligned with the bores of the barrels for slidingly receiving the pivot pin, the bearings disposed between the ends of the barrels and configured to engage one another to facilitate relative rotation of adjacent barrels.

7. The hinge as recited in claim 6, further comprising a plurality of inserts each defining a bore, one of the inserts disposed in each of the bores of the barrels such that the bores of the inserts are axially aligned with the bores of the barrels, each of the inserts defining at least one longitudinal slot, and each of the bearings further comprising a radial projection key, the slot slidingly receiving the radial projection key for preventing relative rotation of the barrels and the bearings.

8. A hinge as recited in claim 7, wherein each bearing comprises a tongue at an outer end, the tongues extending normal to the longitudinal axis of the bearings for covering an end of the inner channel of each of the first and second leafs.

9. A continuous hinge for mounting a door for swinging movement in an opening defined by a frame, the hinge comprising:

an elongated first leaf having a first mounting surface that abuts the door and a first outer channel extending along the length of the first mounting surface such that the first mounting surface is disposed transverse to the first outer channel, the first outer channel being recessed relative to the first mounting surface;

the elongated first leaf having a first inner channel extending continuously along the length of the first leaf;

an elongated second leaf having a second mounting surface that abuts the frame and a second outer channel extending along the length of the second mounting surface such that the second mounting surface is disposed transverse to the second outer channel, the second outer channel being recessed relative to the second mounting surface;

the elongated second leaf having a second inner channel extending continuously along the length of the second leaf;

a plurality of first barrels defining longitudinal bores, each of the first barrels including at least one longitudinally extending arm projecting from a peripheral surface, the at least one longitudinally extending arm received in the first inner channel of the first leaf and a plurality of second barrels defining longitudinal bores, each of the second barrels including at least one longitudinally extending arm projecting from a peripheral surface, the at least one longitudinally extending arm received in the second inner channel of the second leaf, the first and second barrels in an end-to-end relation with the bores of the first and second barrels being aligned, the first barrels alternating with the second barrels;

a plurality of first fasteners extending through the first leaf and engaging and being secured to the plurality of first barrels, the plurality of first fasteners being disposed at least partially in the first outer channel such that the plurality of first fasteners are accessible from the first outer channel and are recessed relative to the first mounting surface and a plurality of second fasteners extending through the first leaf and engaging and being secured to the second barrels, the plurality of second fasteners being disposed at least partially in the second outer channel such that the plurality of second fasteners are accessible from the second outer channel and are recessed relative to the second mounting surface;

a pivot pin extending through the bores of the first and second barrels, the pivot pin joining together the first and second barrels for relative pivoting movement about the pivot pin, the first barrels alternating with the second barrels.

10. The hinge as recited in claim 9, wherein each of the first and second leafs comprises a pair of elongated planar walls having a longitudinal axis and terminating in free inner edges in spaced relation for at least partially defining the inner channel of each of the first and second leafs, and further comprising a longitudinal web extending coextensively with and interconnecting the walls of the each of the first and second leafs intermediate the transverse dimension of the walls orthogonal to the longitudinal axis, the web extending in a plane parallel with longitudinal axis of the first and second leafs and normal to a central transverse plane of the first and second leafs for at least partially defining the inner channel of each of the first and second leafs.

11. The hinge as recited in claim 10, wherein the first leaf and the second leaf pivot about the pivot pin between a closed position and a fully open position where in the fully open position the inner edge of a wall of the first leaf abuts the inner edge of an adjacent wall of the second leaf when the first and second leafs are rotated about the pin to a maximum rotation position for maintaining the leafs in predetermined minimum spaced apart relation.

12. The hinge as recited in claim 10, wherein the longitudinally extending arm of each of the barrels comprises a pair of arms extending coextensively with the barrel in parallel spaced relation for defining a channel.

13. A hinge as recited in claim 9, further comprising a plurality of bearings, each bearing having a bore and disposed in the bores of the barrels at each end of the barrels such that the bores of the bearings are axially aligned with the bores of the barrels for slidingly receiving the pivot pin, the bearings disposed between the ends of the barrels and configured to engage one another to facilitate relative rotation of adjacent barrels.

14. The hinge as recited in claim 13, further comprising a plurality of inserts each defining a bore, one of the inserts disposed in each of the bores of the barrels such that the bores of the inserts are axially aligned with the bores of the barrels, each of the inserts defining at least one longitudinal slot, and each of the bearings further comprising a radial projection key, the slot slidingly receiving the radial projection key for preventing relative rotation of the barrels and the bearings.

15. A hinge as recited in claim 14, wherein each bearing comprises a tongue at an outer end, the tongues extending normal to the longitudinal axis of the bearings for covering an end of the inner channel of each of the first and second leafs.

16. A continuous hinge for connecting between a first member and a second member, wherein at least one of the first member or the second member is movable relative to the other member, the hinge comprising:

an elongated first leaf adapted for attachment to the first movable member, the first leaf comprising:

a pair of elongated planar walls in spaced relation and terminating in free inner edges and free outer edges, a longitudinal web extending coextensively with and interconnecting the pair of walls of the first leaf intermediate the transverse dimension of the walls, the web extending in a plane parallel with the longitudinal axis of the first leaf and normal to a central transverse plane of the first leaf defining inner and outer longitudinal channels extending continuously along the length of the first leaf, and a flange extending transversely in opposite directions from the outer edges of the pair of walls of the first leaf, the flanges being adapted to be secured to the first movable member;

an elongated second leaf adapted for attachment to the second movable member, the second leaf comprising:

a pair of elongated planar walls in spaced relation and terminating in free inner edges and free outer edges, a longitudinal web extending coextensively with and interconnecting the pair of walls of the second leaf intermediate the transverse dimension of the walls, the web extending in a plane parallel with the longitudinal axis of the second leaf and normal to a central transverse plane of the second leaf defining inner and outer longitudinal channels extending continuously along the length of the second leaf, and a flange extending transversely in opposite directions from the outer edges of the pair of walls of the second leaf, the flanges being adapted to be secured to the second movable member;

a plurality of barrels defining longitudinal bores open at each end, each of the barrels including a longitudinally extending arm projecting from a peripheral surface, the arm configured to be received in the inner channel of either the first leaf or the second leaf;

means for attaching the arms of the barrels in the inner channels of the first and second leafs, wherein the barrels in the first and second leafs are in end-to-end relation for axially aligning the bores of the barrels; and a pivot pin extending through the bores of the barrels, the pivot pin configured to be coextensive with the barrels for joining together the barrels and the first and second leaves for relative pivoting movement about the pivot pin, the barrels attached to the first leaf interspersed between the barrels attached to the second leaf in alternating relationship.

17. A continuous hinge for connecting between a first member and a second member, wherein at least one of the first member or the second member is movable relative to the other member, the hinge comprising:

an elongated first leaf adapted for attachment to the first movable member, the first leaf comprising:

a pair of elongated planar walls in spaced relation and terminating in free inner edges and free outer edges, a longitudinal web extending coextensively with and interconnecting the pair of walls of the first leaf intermediate the transverse dimension of the walls, the web extending in a plane parallel with the longitudinal axis of the first leaf and normal to a central transverse plane of the first leaf defining inner and outer longitudinal channels extending continuously along the length of the first leaf, and a flange extending transversely in opposite directions from the outer edges of the pair of walls of the first leaf, the flanges being adapted to be secured to the first movable member;

an elongated second leaf adapted for attachment to the second movable member, the second leaf comprising:

a pair of elongated planar walls in spaced relation and terminating in free inner edges and free outer edges, a longitudinal web extending coextensively with and interconnecting the pair of walls of the second leaf intermediate the transverse dimension of the walls, the web extending in a plane parallel with the longitudinal axis of the second leaf and normal to a central transverse plane of the second leaf defining inner and outer longitudinal channels extending continuously along the length of the second leaf, and a flange extending transversely in opposite directions from the outer edges of the pair of walls of the second leaf, the flanges being adapted to be secured to the second movable member;

a plurality of barrels defining longitudinal bores open at each end, each of the barrels including a longitudinally extending arm projecting from a peripheral surface, the arm configured to be received in the inner channel of either the first leaf or the second leaf;

means for attaching the arms of the barrels in the inner channels of the first and second leafs, wherein the barrels in the first and second leafs are in end-to-end relation for axially aligning the bores of the barrels; and a pivot pin extending through the bores of the barrels, the pivot pin configured to be coextensive with the barrels for joining together the barrels and the first and second leaves for relative pivoting movement about the pivot pin, the barrels attached to the first leaf interspersed between the barrels attached to the second leaf in alternating relationship, wherein the inner edge of a wall of the first leaf abuts the inner edge of an adjacent wall of the second leaf when the first leaf and the second leaf are rotated about the pin to a maximum rotation position such that in the maximum rotation position a maximum included angle between the leaves is 102 degrees or less for maintaining the leafs in predetermined minimum spaced apart relation.

18. A continuous hinge for mounting a door for swinging movement in an opening defined by a frame, the hinge comprising:

an elongated first leaf adapted for attachment to the door, the first leaf comprising:

a pair of elongated planar walls in spaced relation and terminating in free inner edges and free outer edges, a longitudinal web extending coextensively with and interconnecting the pair of walls of the first leaf intermediate the transverse dimension of the walls, the web extending in a plane parallel with the longitudinal axis of the first leaf and normal to a central transverse plane of the first leaf defining inner and outer longitudinal channels extending continuously along the length of the first leaf, and a flange extending transversely in opposite directions from the outer edges of the pair of walls of the first leaf, the flanges being adapted to be secured to the door;

an elongated second leaf adapted for attachment to the frame, the second leaf comprising:

a pair of elongated planar walls in spaced relation and terminating in free inner edges and free outer edges, a longitudinal web extending coextensively with and interconnecting the pair of walls of the second leaf intermediate the transverse dimension of the walls, the web extending in a plane parallel with the longitudinal axis of the second leaf and normal to a central transverse plane of the second leaf defining inner and outer longitudinal channels extending continuously along the length of the second leaf, and a flange extending transversely in opposite directions from the outer edges of the pair of walls of the second leaf, the flanges being adapted to be secured to the frame;

a plurality of barrels defining longitudinal bores open at each end, each of the barrels including a longitudinally extending arm projecting from a peripheral surface, the arm configured to be received in the inner channel of either the first leaf or the second leaf;

means for attaching the arms of the barrels in the inner channels of the first and second leafs, wherein the barrels in the first and second leafs are in end-to-end relation for axially aligning the bores of the barrels; and a pivot pin extending through the bores of the barrels, the pivot pin configured to be coextensive with the barrels for joining together the barrels and the first and second leafs for relative pivoting movement about the pivot pin, the barrels attached to the first leaf interspersed between the barrels attached to the second leaf in alternating relationship.

19. A continuous hinge for mounting a door for swinging movement in an opening defined by a frame, the hinge comprising:

an elongated first leaf adapted for attachment to the door, the first leaf comprising:

a pair of elongated planar walls in spaced relation and terminating in free inner edges and free outer edges, a longitudinal web extending coextensively with and interconnecting the pair of walls of the first leaf intermediate the transverse dimension of the walls, the web extending in a plane parallel with the longitudinal axis of the first leaf and normal to a central transverse plane of the first leaf defining inner and outer longitudinal channels extending continuously along the length of the first leaf, and a flange extending transversely in opposite directions from the outer edges of the pair of walls of the first leaf, the flanges being adapted to be secured to the door;

an elongated second leaf adapted for attachment to the frame, the second leaf comprising:

a pair of elongated planar walls in spaced relation and terminating in free inner edges and free outer edges, a longitudinal web extending coextensively with and interconnecting the pair of walls of the second leaf intermediate the transverse dimension of the walls, the web extending in a plane parallel with the longitudinal axis of the second leaf and normal to a central transverse plane of the second leaf defining inner and outer longitudinal channels extending continuously along the length of the second leaf, and a flange extending transversely in opposite directions from the outer edges of the pair of walls of the second leaf, the flanges being adapted to be secured to the frame;

a plurality of barrels defining longitudinal bores open at each end, each of the barrels including a longitudinally extending arm projecting from a peripheral surface, the arm configured to be received in the inner channel of either the first leaf or the second leaf;

means for attaching the arms of the barrels in the inner channels of the first and second leafs, wherein the barrels in the first and second leafs may be placed in end-to-end relation for axially aligning the bores of the barrels; and a pivot pin extending through the bores of the barrels, the pivot pin configured to be coextensive with the barrels for joining together the barrels and the first and second leafs for relative pivoting movement about the pivot pin, the barrels attached to the first leaf interspersed between the barrels attached to the second leaf in alternating relationship, wherein the inner edge of a wall of the first leaf abuts the inner edge of an adjacent wall of the second leaf when the first leaf and the second leaf are rotated about the pin to a maximum rotation position such that in the maximum rotation position a maximum included angle between the leaves is 102 degrees or less for maintaining the leafs in predetermined minimum spaced apart relation.

* * * * *